United States Patent [19]

Preu

[11] Patent Number: 4,793,495

[45] Date of Patent: Dec. 27, 1988

[54] FILM STORAGE SYSTEM

[76] Inventor: Axel Preu, Moderne Elemat GmbH, Postfach 23 03 42, D 7000 Stuttgart 23, Fed. Rep. of Germany

[21] Appl. No.: 101,758

[22] Filed: Sep. 28, 1987

[30] Foreign Application Priority Data

Oct. 9, 1986 [DE] Fed. Rep. of Germany ..... 3634442

[51] Int. Cl.[4] ..... A47F 5/00

[52] U.S. Cl. ..... 211/41; 40/375; 211/94; 312/184

[58] Field of Search ..... 312/184; 211/46, 94, 211/40, 41; 40/375, 374, 359, 360

[56] References Cited

U.S. PATENT DOCUMENTS

| | | | |
|---|---|---|---|
| 1,274,191 | 7/1918 | Nixon et al. | 40/375 X |
| 1,990,020 | 2/1935 | Blackwood | 40/375 |
| 2,962,335 | 11/1960 | Benson | 312/184 |
| 3,185,309 | 5/1965 | Radek | 211/94 X |
| 3,288,543 | 11/1966 | Sugerman | 40/375 X |
| 3,570,678 | 3/1971 | Lundberg | 211/46 |
| 3,798,810 | 3/1974 | Brisson et al. | 312/184 X |
| 4,674,637 | 6/1987 | Lovelock et al. | 211/46 |

*Primary Examiner*—Robert W. Gibson, Jr.
*Attorney, Agent, or Firm*—Jones, Askew & Lunsford

[57] ABSTRACT

There is disclosed a film storage system consisting of a series of elongated tracks each with a C-shaped internal groove along its length. The tracks are mounted on an shelving unit. Plastic storage envelopes having textured surfaces and a sliding closure are suspended from the tracks by means of a rib and connecting piece along the top of the envelope which rib and connecting piece slide into the C-shaped groove. Each track has an identification label attached to the shelving unit and each envelope has a corresponding identification label on the connecting piece which is visible when the rib is within the groove. Each envelope also has a handle formed in the connecting piece.

5 Claims, 5 Drawing Sheets

FILM STORAGE SYSTEM

BACKGROUND OF THE INVENTION

This invention relates to a film storage system, and more particularly concerns a film storage system that saves space, protects the film from contamination and damage, and has identification labels for easy retrieval.

Flat, large-size film is used by the manufacturers of electronic integrated circuits, printed circuit boards, and in the printing business. Because such film is used in large quantities, there should be a dedicated film storage system available. The film storage system must be able to handle large quantities of film without using much space. Because such film is used in precision manufacturing processes, the film must be of the highest quality. Consequently, the film storage system must protect the film from being dirtied, damaged or scratched when taken from or put back into storage or during storage. It is also important that the film can be located quickly when required during the manufacturing process.

Present film storage systems cannot satisfy the described requirements. There are known storage envelopes, which are open at the top. The film stored in such envelopes can get dusty. Moreover, the film can fall out of such envelopes during storage or retrieval and can be damaged.

In other known film storage systems the film hangs directly in storage cabinets. With such a storage system, the film itself must be mounted to an additional stiffening and hanging device. Such a storage system provides no protection against scratching and dust.

Film has also been stored in flat horizontal envelopes. Such a storage system, as with direct hanging of the film, does not prevent the danger of cracking or breaking of the film.

A further disadvantage of most existing film storage systems is that the storage location of the film is not labeled so that the labels are clearly visible. In most cases there is no fixed, defined position for the film and locating a specific film may be time consuming.

Prior art film hanging systems, either for envelopes or film directly, are not satisfactory. Usually, the envelopes or the film is is hung from a hook, from grips on a rail, or from a pin in the storage cabinet. These types of storage systems depend on suspension of the film from a single point or points. When somebody looks for a particular film, the stored film can easily tear loose or dislodge from the points or suspension and fall.

Some prior art film storge systems use either a paper material or a plastic material for storage envelopes. Paper material has the disadvantage that it can scratch the film rather easily. Dark plastic, like paper, is opaque and one cannot see what is in the storage envelope. Moreover, many kinds of plastic material, although transparent, may adhere to the film inside the envelope and damage the film or at least make its removal difficult. Also, most film storage systems provide no means for carrying the film once retrieved from storage.

SUMMARY OF THE INVENTION

It is therefore an object of the present invention to provide a film storge system in which the film will have a fixed storage position, is kept free of contamination, and can be retrieved without delay from its storage position.

In order to achieve the foregoing objectives, the film protection against scratching and dust.

Film has also been stored in flat horizontal envelopes. Such a storge system, as with direct hanging of the film, does not prevent the danger of cracking or breaking of the film.

A further disadvantage of most existing film storage systems is that the storage location of the film is not labeled so that the labels are clearly visible. In most cases there is no fixed, visible label position for the film and locating a specific film may be time consuming.

Prior art film hanging systems, either for envelopes or film directly, are not satisfactory. Usually, the envelopes or the film is is hung from a hook, from grips on a rail, or from a pin in the storage cabinet. These types of storage systems depend on suspension of the film from a single point or points. When somebody looks for a particular film, the stored film can easily tear loose or dislodge from the points of suspension and fall.

Some prior art film storage systems use either a paper material or a plastic material for storage envelopes. Paper material has the disadvantage that it can scratch the film rather easily. Dark plastic, like paper, is opaque and one cannot see what is in the storage envelope. Moreover, many kinds of plastic material, although transparent, may adhere to the film inside the envelope and damage the film or at least make its removal difficult. Also, most film storage systems provide no means for carrying the film once retrieved from storage.

SUMMARY OF THE INVENTION

It is therefore an object of the present invention to provide a film storage system in which the film will have a fixed storage position, is kept free of contamination, and can be retrieved without delay from its storage position.

In order to achieve the foregoing objectives, the film storage system comprises a set of elongated tracks with internal C-shaped grooves mounted on a shelf unit for engaging and holding a set of transparent plastic storage envelopes. The envelopes are equipped with a zipper for closing the envelope so that during storage and during transport to and from the production areas the film is protected from dust, contamination, and damage. The zipper closure also assures that the film cannot accidentally fall out of the envelope. A rib on the storage envelope slides into the groove on the track and provides a sure and tear free suspension system. The use of the enlongated groove and rib provides support equally over the entire length of the envelope. Consequently, envelopes cannot distort or dislodge from the hanging position. Also, because of the vertical hanging arrangement of the storage system, very little storage space is needed.

Every envelope is assigned a specific track from which the envelope is suspended. The tracks are attached to a shelf of a shelving unit, and the contents of the envelope can be indicated on the shelf. In addition the storage envelopes can protrude slightly from the track so that a label placed on the protruding portion of the envelope is clearly visible to identify the contents of the storage envelope. The use of transparent storage envelopes made from plastic material, also makes it possible to identify quickly the contents of the envelope.

The storage envelopes are used to store all kinds of film as well as glass masters. The inside of the storage envelopes are textured to prevent the film or glass masters from sticking to the inside surface of the envelopes. Also by giving the outside surfaces of the envelopes a light satin finish (or other texture) reflections can be controlled.

The storage envelopes can also be equipped with a carrying handle so that each storage envelope, including its contents, can be easily grasp and transported.

Other characteristics and advantages of this invention will become clear from the description in conjunction with the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
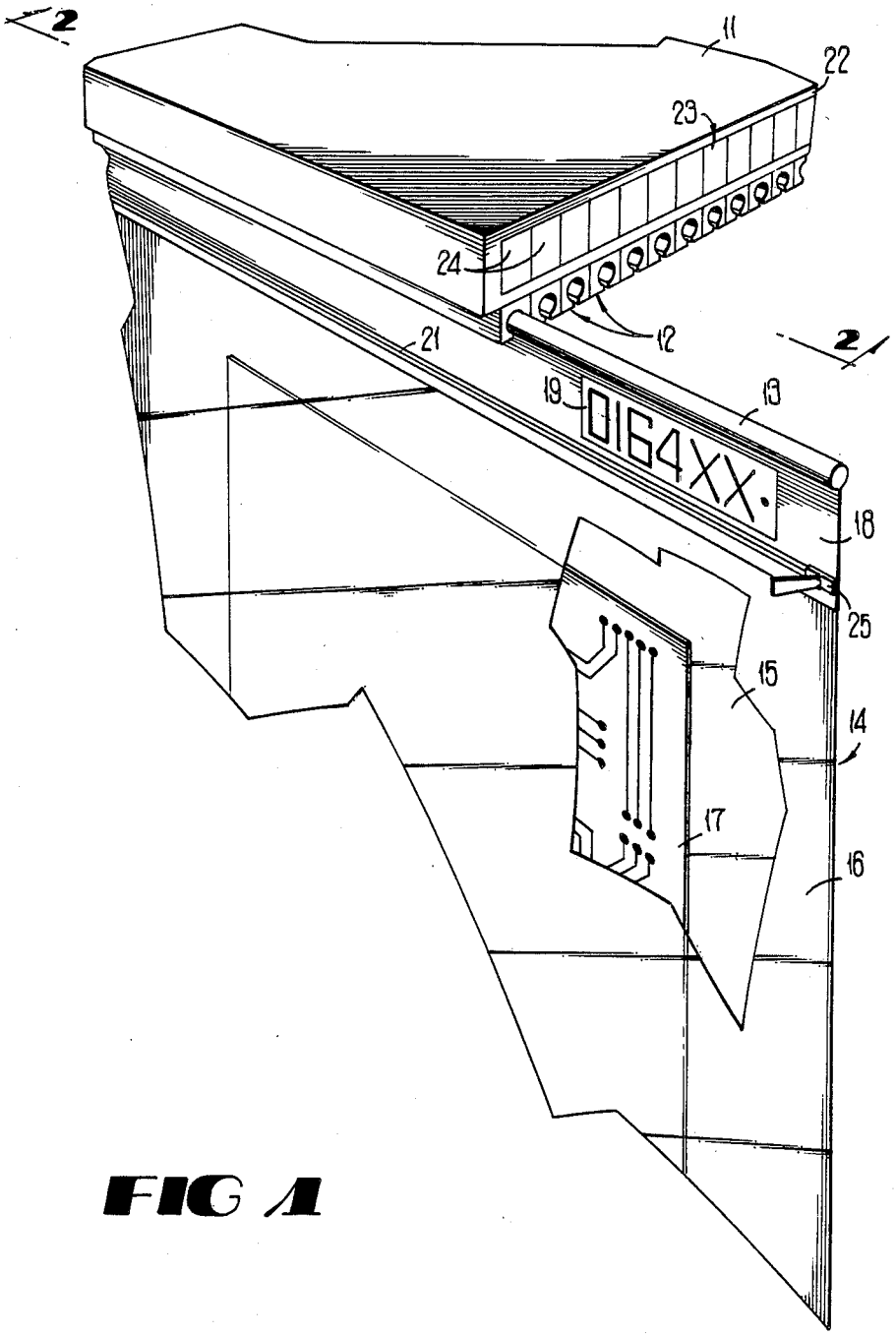
FIG. 1 is a perspective view showing a section of the film storage system of the present invention.
Figure 7:
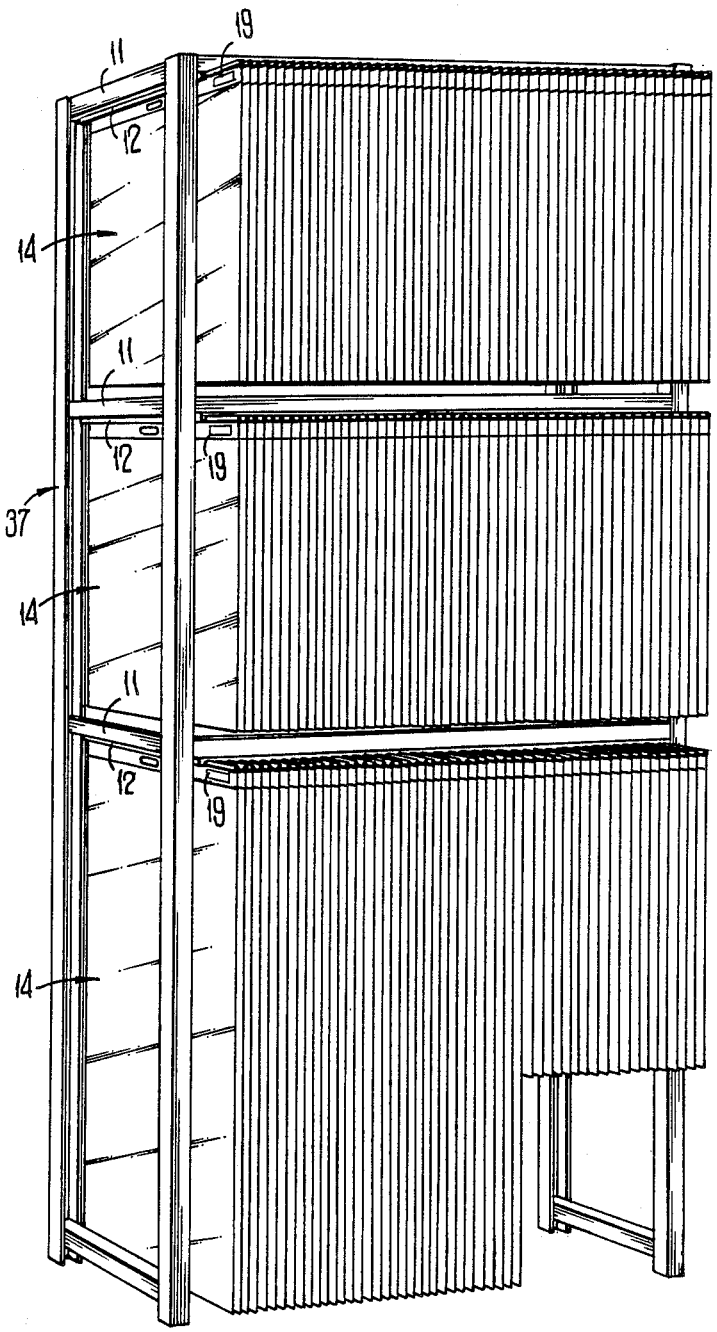
FIG. 7 is a perspective view of the film storage system of the present invention.

Turning to FIGS. 1 and 7, there is shown the film storage system of the present invention. The film storage system includes a shelving unit 37 consisting of supporting legs and a number of shelves 11. A set of parallel tracks 12 is attached to the bottom side of each shelf 11. A storage envelope 14 is suspended from each track 12 by means of a rib 3 on the storage envelope 14, which rib is inserted into and engages a C-shaped groove 31 of the track 12.

The storage envelope 14 has a front side 15 and a back side 16 which are joined to form a flat storage compartment. A film 17 for a printed circuit board is placed inside the storge envelope 14. The storage envelope is plastic, and the inside and outside of both the back side 16 and the front side 15 are textured. A flat connecting piece 18 is provided between the rib 13 and the back side 16 and the front side 15. The flat connecting piece 18 has a label area 19. A zip fastener 21 is located between the front side 15 and the flat connecting piece 18 and serves to close the storage envelope. The zip fastener 21 is for example a sliding zipper with grip 25, but other fastners such as a press fastener can be used.

The tracks 12 are assembled to the shelf 11 for example by gluing, screwing, welding or by any other means. Properly, the track 12 is exactly as long as the shelf 11 is deep. A description or index strip 23, divided into fields 24, is positioned on the narrow front side 22 of the shelf 11. Information can be provided on each description field 24 attached to shelf 11 which information corresponds with the information on the identification label 19 on the storage envelope 14.

Figure 2:
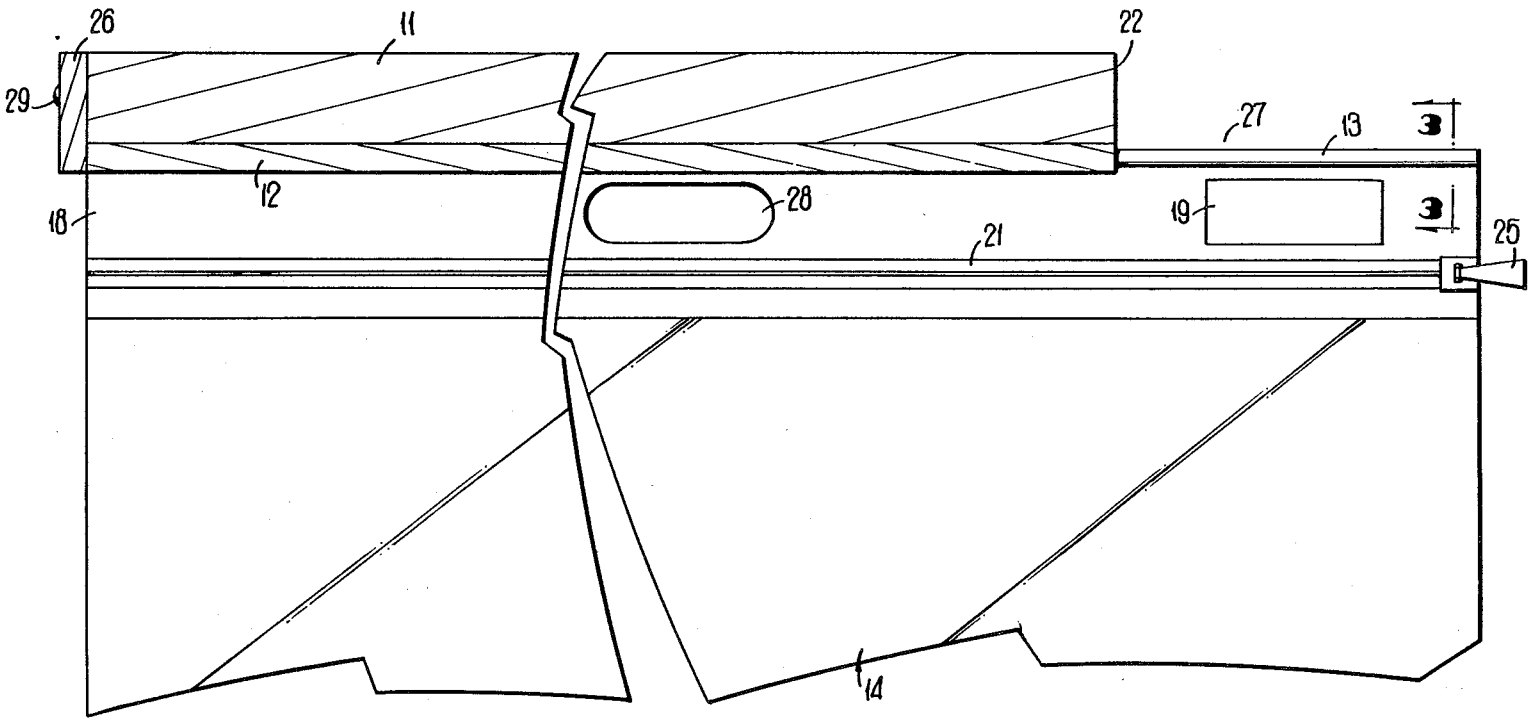
FIG. 2 is a sectional view of a storage envelope connected to a track and a shelf as seen along line 2—2 of FIG. 1.

Turning to FIG. 2, it can be seen that the shelf 11 at the back side (left in FIG. 2) has been equipped with a stop 26. The stop 26 engages and stops the rib 13 of the storage envelope 14 when the storge envelope 14 has been pushed all the way back into the track 12. The stop 26 is attached to the shelf by a screw 29 so that the stop 26 can be eliminated when narrower storage envelopes 14 are used, and those storage envelopes 14 are inserted from both sides of the track 12 to produce a double-sided storage system. With the stop 26 in place and with the track 12 shorter than the width of the storage envelope 14, the storage envelope 14 with a film 27 therein protrudes beyond the shelf 11 so that the description label 19 is positioned to be visible without removing the storage envelope from the track.

The storage envelope 14 has a hand grip 28, which is located in the connecting piece 18 of the storage envelope 14. As soon as the storage envelope has been drawn far enough out of the track to expose the handle 28, the user can grasp the storage envelope by the hand grip 28.

Figure 3:
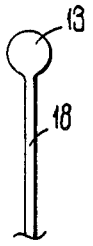
FIG. 3 is a sectional view of the storage envelope as seen along line 3—3 of FIG. 2.

FIG. 3 shows the rib 13 in cross section. The rib 13 as previously indicated is positioned on top of the connecting piece 18 and serves as a guide and fastener of the storage envelope 14 inside the track 12. The rib and connecting piece together are keyhole shaped.

Figure 4:
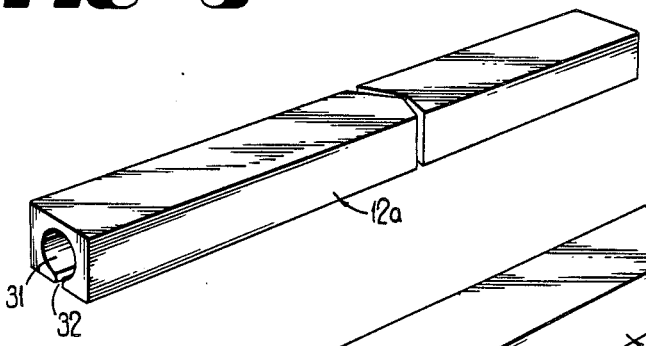
FIG. 4 is perspective view of two tracks used in connection with the present invention.
Figure 4:
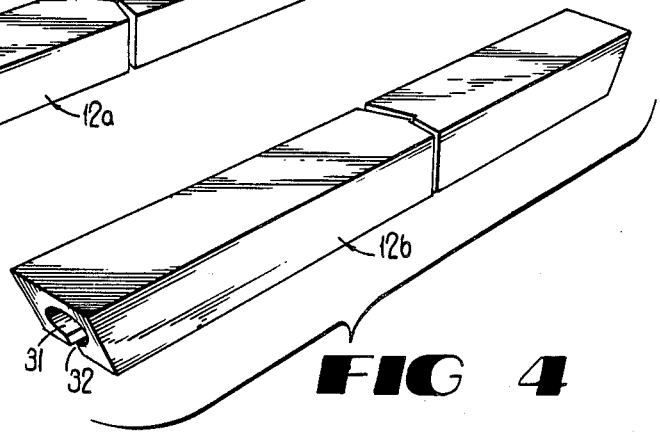

FIG. 4 is shows a single track 12*a* which is one embodiment of track 12. The track has a basically square cross-section. To accommodate the rib 13 the internal groove 31 extends along the length of track 12. The groove 31 of the track 12 has a C-shaped cross-section. The opening of the C is a slot 32 at the bottom which slot accommodates the connecting piece 18 of the storage envelope 14. To facilitate insertion of the rib 13 into the groove 31, the entrance side of the track may be angled as illustrated by track 12*b*.

Figure 5:
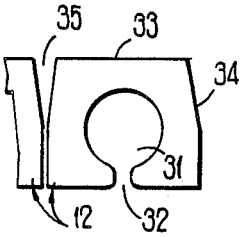
FIG. 5 is a partial front elevation view of an alternative embodiment of a track.
Figure 6:
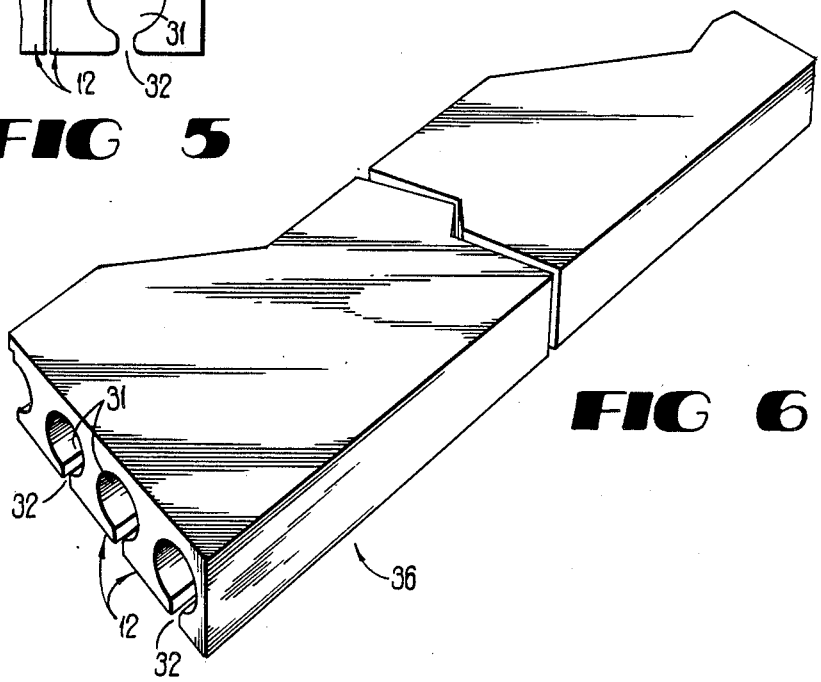
FIG. 6 is a perspective view of another embodiment of a track for the present invention.

FIG. 5 shows a variation of track 12. As already mentioned, the track 12 is fastened to shelf 11 along surface 33 opposite slot 32. In the embodiment shown in FIG. 5, the surfaces adjacent to the top surface 33 are provided with an angle 34 which produces voids 35 between each track. If the track 12 is glued to the shelf, the glue will penetrate into the void 35 created by the angled areas 34 between two neighboring tracks 12 and thereby increasing the strength of the glued assembly. It is also possible that a number of tracks 12 can be formed from a single trackplate 36 as shown in FIG. 6.

Figure 8:
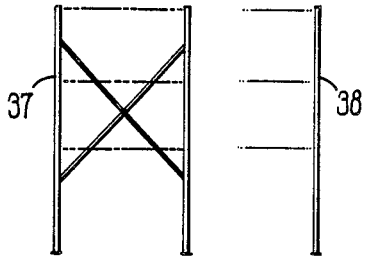
FIG. 8 is a schematic representation showing how the storage system may be expanded.

FIG. 7 shows the complete shelving unit 37 in which storage envelopes 14 have been placed. The storage envelopes somewhat protrude from the shelves as previously described so that the levels 19 are clearly visible and recognizable. Commercially available shelving units can be used in connection with the present invention. As shown in FIG. 8, the film storage system is easily expanded by adding an expansion unit 38 to the basic shelving unit 37.

Figure 9:
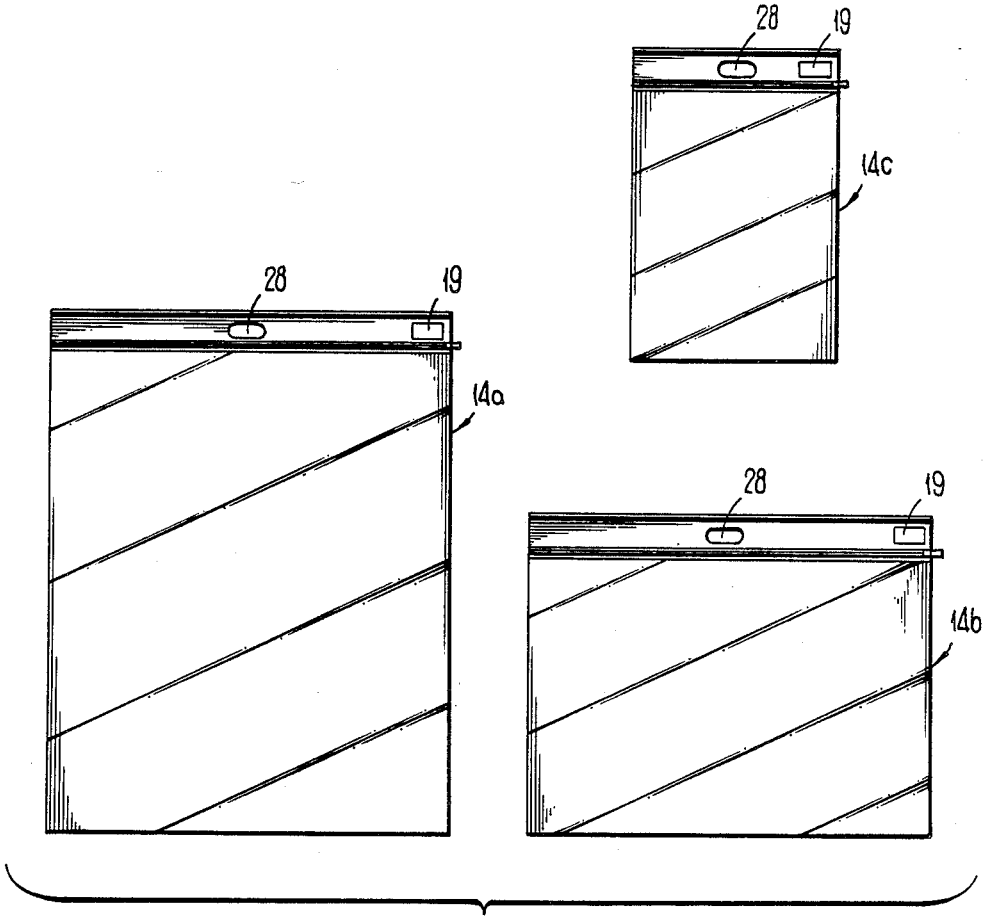
FIG. 9 is a front elevation view showing a series of different storage envelopes.

FIG. 9 shows several kinds of storage envelopes 14: storage envelope 14*a* has a normal width, but has an increased length; storage envelope 14*b* has a normal width, but has a short length; and storage envelope 14*c* has a narrow width and a short length. As already explained, depending on the depth of the shelf 11, two storage envelopes 14 could be placed in a track 12.

I claim:

1. A film storage system comprising:

a. an elongated track with a groove therein;

b. a unitary storage envelope and hanging support means comprising:

i. a front side and back side interconnected to form a storage compartment with a top edge and an opening;

ii. fastener means for closing the opening connected to said envelope;

iii. an integral connecting piece along the top edge; and iv. an integral elongated rib along the connecting piece for insertion in the groove.

2. The film storage system of claim 1, wherein the front side and back side are transparent textured plastic.

3. The film storage system of claim 1, wherein the connecting piece has a handle opening provided therein.

4. The film storage system of claim 1, wherein the track and envelope are dimensioned so that the envelope protrudes from one end of the track to expose a portion of the connecting piece.

5. The film storage system of claim 4, wherein a label is provided on the exposed portion of the connecting piece and a description field is provided on the track adjacent the exposed connecting piece.

* * * * *